United States Patent [19]

Justus

[11] 4,227,658

[45] Oct. 14, 1980

[54] PAPER WINDER ASSEMBLY INCLUDING PRESSURE MODULATING VALVE

[75] Inventor: Edgar J. Justus, Beloit, Wis.

[73] Assignee: Beloit Corporation, Beloit, Wis.

[21] Appl. No.: 941,315

[22] Filed: Sep. 11, 1978

[51] Int. Cl.[3] ..... B65H 17/08

[52] U.S. Cl. ..... 242/66; 91/433

[58] Field of Search ..... 242/66, 65; 91/433, 91/461; 137/625.6, 625.61, 625.62, 625.63, 625.64

[56] References Cited

U.S. PATENT DOCUMENTS

| | | | |
|---|---|---|---|
| 2,825,361 | 3/1958 | Seljos | 91/433 X |
| 3,599,889 | 8/1971 | Pfeiffer | 242/66 |
| 3,958,495 | 5/1976 | Bernhoft | 91/433 |

*Primary Examiner*—John M. Jillions

*Attorney, Agent, or Firm*—Hill, Van Santen, Steadman, Chiara & Simpson

[57] ABSTRACT

A paper winder assembly of the type in which a rider roll is positioned to bear against a roll on which the traveling paper web is being wound. The rider roll position is controlled by hydraulically actuated lifting means which vary the pressure at which the rider roll bears against the paper roll. In accordance with the present invention, there is included a pressure modulating valve which converts air pressure signals to hydraulic signals which operate the hydraulically actuated lifting means. The valve includes a pair of flexible diaphragms therein with means to introduce air under pressure on opposite sides of the two diaphragms depending upon whether the rider roll is to be raised or lowered. The valve has a spool actuator therein which is movable in response to the movement of either of the diaphragms. A spring means biases the spool downward and establishes fluid communication between an inlet port and an outlet port for transmitting hydraulic fluid to the hydraulically actuated lifting means. A feedback is provided in the valve body so that fluid pressure acts on the spool in opposition to the spring biasing force and eventually establishes an equilibrium position. When the back pressure of the hydraulic lifting system is sufficiently high, the spool is positioned in valve closing relationship, and excess hydraulic fluid is passed to a drain.

2 Claims, 4 Drawing Figures

PAPER WINDER ASSEMBLY INCLUDING PRESSURE MODULATING VALVE

BACKGROUND OF THE INVENTION

1. Field of the Invention

This invention is in the field of paper winding assemblies and, more particularly, to a control system for raising and lowering a rider roll into variable pressure applying relationship with a roll of paper being wound up. The invention also includes an improved double diaphragm valve assembly which translates differences in air pressure into differences in hydraulic pressure used to raise and lower a rider roll.

2. Description of the Prior Art

It is well known that in winding large diameter rolls of paper wherein the roll of paper is placed on power driven winding drums and rotatably driven, as the web material is wound about its winder shaft the wound roll increases in hardness as the diameter and the weight of the roll increases, with the result that a nonuniform density may result in the rewound roll of paper. This density can be controlled by the use of a rider roll bearing on the top of the roll of paper and applying pressure on the roll by virtue of its own weight. Suitable lifting mechanism may be provided to opposite ends of the winder shaft to remove some of the weight of the roll of paper from the nips between the roll of paper and the winding drums.

In Daly, U.S. Pat. No. 3,282,526, there is described a drum winder for paper in which the nip pressures between the roll and the winding drums is relieved by applying a lifting force to the opposite ends of the winder shaft and by subjecting the winder shaft to an oppositely directed cantilever bending action. This action counteracts the deflection of the winder shaft so that it assumes an S-shaped deflection curve and more nearly approaches a straight line, and thereby tends to produce a more uniform density in the roll.

Dorfel, U.S. Pat. No. 3,604,649 refers to a different type of rider roll assembly for securing a uniform winding tightness along the width of the web and between adjacent layers of the wound roll. A rider roll is positioned in pressure engagement with the generated surface of the wound roll and diametrically opposite thereto, there is a loading roller which is operable to apply a variable force to the wound roll corresponding to the increasing weight of the wound roll so that the contact pressure between the wound roll and the rider roll is maintained constant or varies in a predetermined manner.

One of the problems associated with a rider roll assembly is that of vibration, particularly during high speed winding operations. In Dahl et al, U.S. Pat. No. 4,047,676, there is described a means for dampening this vibration, utilizing a device which has an elongated hollow tube fitting into or attached to one side of the beam which is coextensive with the rider roll. The rider roll is mounted at its ends and bearings on the beam. Within the outer stationary hollow tube or cylinder there is an inner beam and a continuous elastic tubing is annularly or spirally wound around this inner beam. Between the outside of the tubing on the inner surface of the tubular member there is a layer of steel slats which extend parallel to the axis of the beam. At the outer surface of the slats there is laminated a sheet of fibrous material. The tubing is inflated with a desired air pressure to force the slats outwardly against the inner surface of the cylindrical tube and thereby provide for energy absorption transferred from the beam to the cylinder.

Previously used systems for adjusting rider roll pressure sometimes made use of separately functioning air and oil valves for the pneumatic and hydraulic portions of the control circuit, respectively, in combination with a solenoid. This type of system is reasonably complicated and provided possible areas of failure in numerous places. Some rider roll balancing systems made use of relatively massive counterweights. Such expensive deadweighting is not practical for relatively large rider roll systems.

SUMMARY OF THE INVENTION

The present invention provides a control system for adjusting the pressure being applied by a rider roll characterized in that it has fewer components than previous pneumatic-hydraulic circuits used for the same purpose, and a simplified control system.

The control system of the present invention converts air pressure changes inversely into proportional changes in hydraulic pressure, i.e., an increase in the air pressure causes a corresponding decrease in hydraulic pressure at the elevating mechanism of the rider roll, such that an increased rider roll pressure results. In this way, the control system of the present invention takes advantage of the ease of control offered by pneumatic systems and the more efficient and more economical use of a hydraulic system as the actual force applicator system.

In accordance with the present invention I provide a valve which has a pair of flexible diaphragms therein. A spool is located in the valve and is movable in response to movement of either of the two diaphragms. Pressurized air is introduced into the valve selectively so as to extend one or the other of the diaphragms. The valve is provided with inlet means for introducing pressurized liquid into the valve and outlet means for directing pressurized liquid from the valve into the hydraulically actuated lifting means operating on the rider roll.

A spring within the valve is manually adjustable to preload the spool and urge it toward a position in which fluid communication is established between the inlet and outlet means. When a sufficient pressure builds up at the outlet, there is provided an internal feedback by means of a passageway which connects the outlet means with the bottom of the spool, thereby applying an upward force on the spool in opposition to the bias provided by the spring. Eventually, a more or less equilibrium position is established between the two forces. The valve spool is balanced at the pressure determined by the setting of the spring. Any further increase in output pressure causes the spool to shift upward further, shutting off the supply of hydraulic fluid to the valve and allowing the excess fluid to bleed off through a drain port.

As air pressure is supplied to one side of either diaphragm, such air pressure acts to move the spool either in line with the bias provided by the spring or directly in opposition thereto. The controlled supply, therefore, is effective to provide a fine control over the position of the rider roll by modifying the position determined by the presetting of the spring bias against the spool.

BRIEF DESCRIPTION OF THE DRAWINGS

A preferred form of the present invention illustrated in the attached sheets of drawings in which.

DESCRIPTION OF THE PREFERRED EMBODIMENTS

Figure 1:
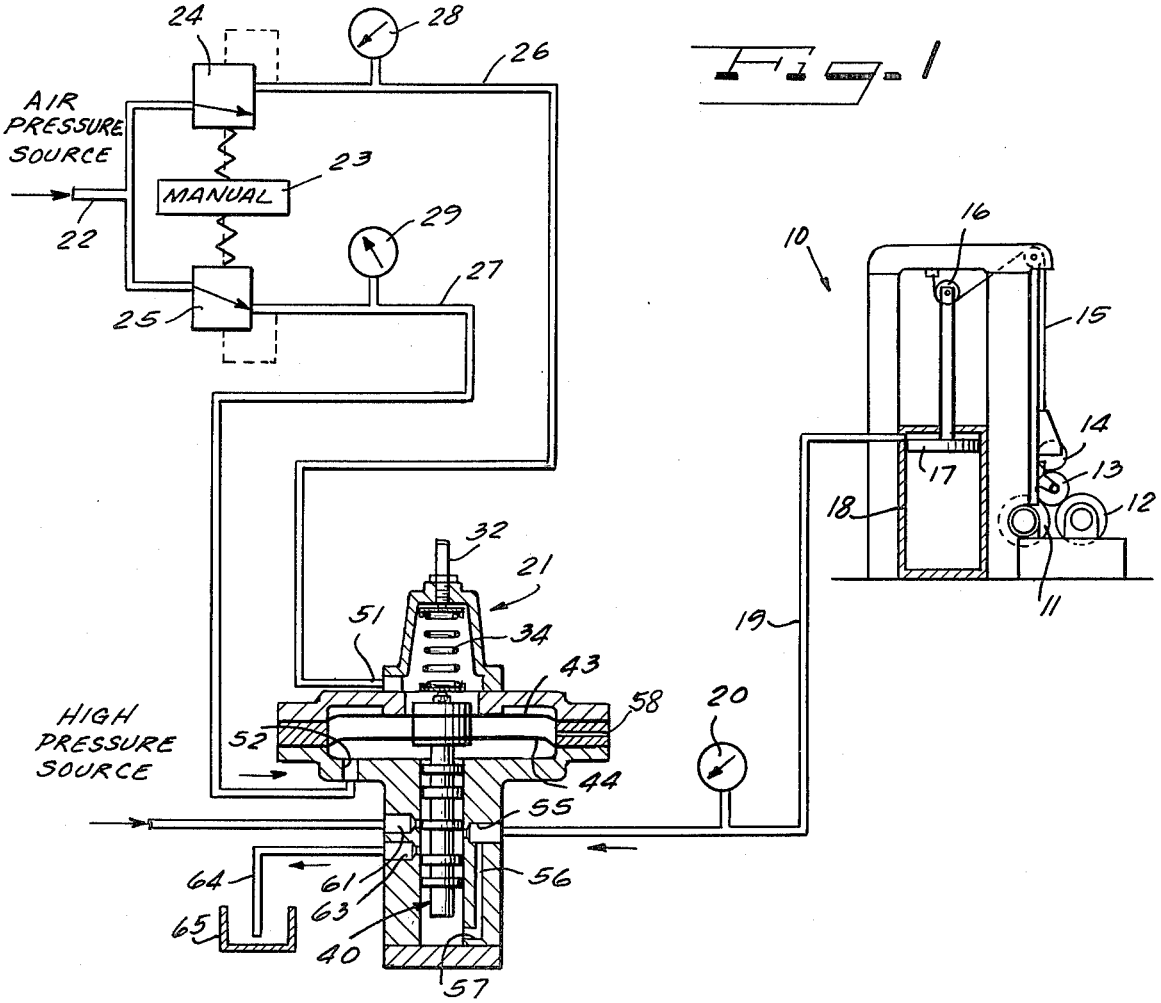
FIG. 1 is a somewhat schematic view of an assembly for raising or lowering a rider roll, including the improved pressure modulating valve assembly invention and wherein air pressure is being introduced against the lower of the two diaphragm assemblies.

Turning first to FIG. 1 there is shown generally at reference numeral 10 a winder assembly including a pair of horizontally aligned winder drums 11 and 12 which coact to define a winding nip therebetween. A paper roll 13 is supported on the drums 11 and 12 and a rider roll 14 applies an adjustable weight at the nip between the two winder drums 11 and 12. The carriage on which rider roll 14 is supported is raised and lowered by means of a pair of chains 15, only one of which is shown in FIG. 1. The chains 15 are trained around sprockets 16 which are adjustably positionable vertically since they are secured to one or more pistons 17 which are arranged for variable displacement within one or more cylinders 18.

Other details of the mechanical structure for supporting a rider roll relative to winder drums will be found in the aforementioned Daly, U.S. Pat. No. 3,282,526 whose disclosure is incorporated herein by reference.

Pressurized hydraulic fluid is supplied to a cylinder 18 by means of a conduit 19 in which there is located a pressure gauge 20. Control of the flow of hydraulic fluid in the conduit 19 is accomplished by means of a pressure modulating control valve generally indicated at reference numeral 21 of the drawings. Briefly stated, the valve 21 is both a pressure reducing and a pressure relieving valve, combining both functions into one. If the pressure downstream of the valve is too high, feedback of hydraulic fluid occurs through the conduit 19 and the excess fluid may be moved to a drain, as will be hereinafter explained.

The air signal for increasing or decreasing the hydraulic fluid pressure in the cylinder 18 is introduced into the system by means of a conduit 22. A manual controller 23 is positioned between a pair of regulator valves 24 and 25 which feed conduits 26 and 27 respectively. Pressure gauges 28 and 29 are used to determine the air pressure in the conduits 26 and 27.

In the particular embodiment shown in FIG. 1, valve 25 is open so that there is air pressure in the conduit 27 from the air pressure source appearing at the inlet line 22.

Figure 3:
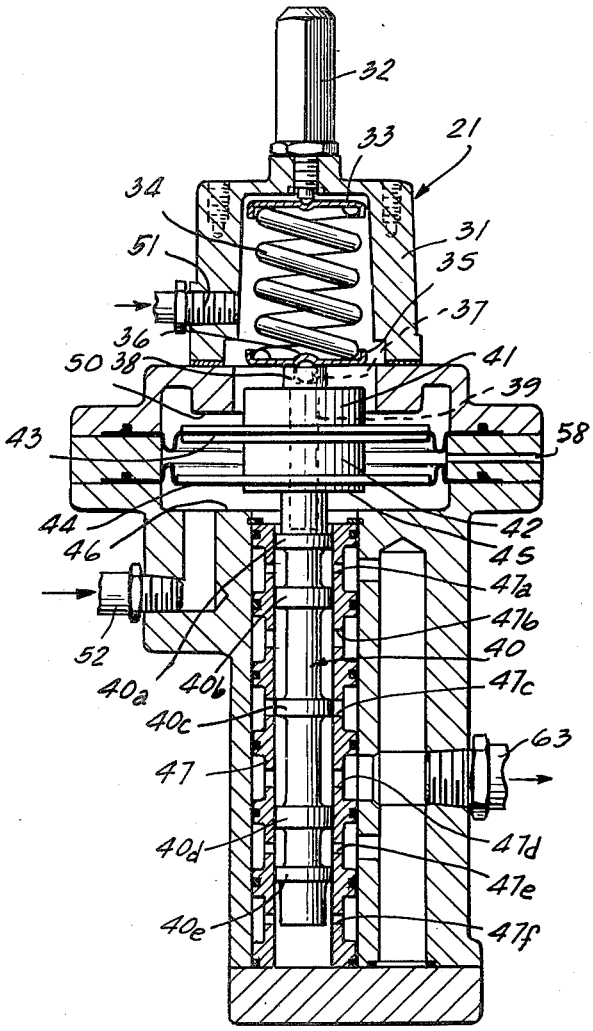
FIG. 3 is a cross-sectional view on an enlarged scale of the improved valve of the present invention.
Figure 4:
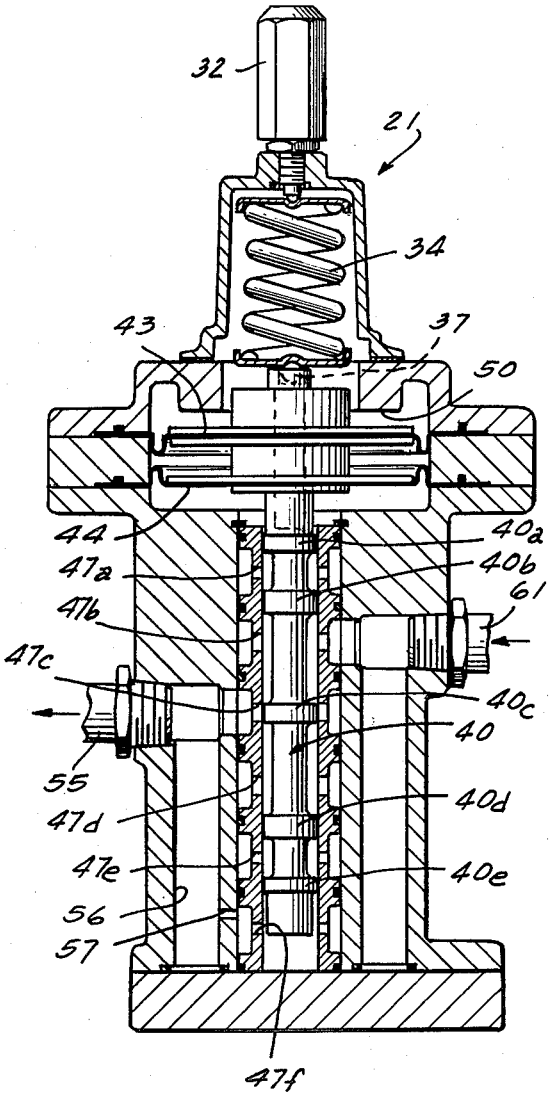
FIG. 4 is a cross-sectional view taken 90° from the cross-sectional view of FIG. 3.

In order to understand the operation of the improved modulating valve of the present invention, it would be well to consider the more detailed showings in FIGS. 3 and 4. As shown in those Figures, there is provided a bonnet 31 into which there is threaded a stud 32. The lower end of the stud 32 abuts against a spring seat 33 which presses down on a coiled compression spring 34, the base of which is received in a spring plate 35. The spring plate 35 is provided with a dimple 36 against which there is seated a ball 37 which, in turn, is received in a headed end portion 38 of a bolt 39. The purpose of the ball and dimple is to assure that the pressure exerted by the spring 34 is solely in the vertically downward direction, the slight movement possible between the ball and the dimple compensating for any slight wobbling, without using extremely close tolerances.

The lower end of the bolt 39 is threaded into a spool 40 which is provided with lands **40*a*, 40*b*, 40*c*, 40*d* and 40*e*** respectively.

A pair of spacers 41 and 42 are positioned along the bolt 39 and between them there is an upper flexible diaphragm member 43. The lower spacer 42 serves to define the spacing between the upper flexible diaphragm member 43 and a lower flexible diaphragm member 44. Located between the lower diaphragm member 44 and the spool 40 is a diaphragm washer 45.

As best seen in FIGS. 3 and 4, the peripheries of the two diaphragm members 43 and 44 are clamped in the valve housing. The upper limit of travel of the diaphragm assembly is determined by the position of a shoulder 50 in the valve housing, and the lower limit is provided by a surface 46 against which the diaphragm washer 45 may abut. A vent 58 continuously vents the space between the diaphragms 43 and 44 to the atmosphere.

The spool 40 is arranged for sliding movement within a sleeve 47 along which are provided pluralities of apertures **47*a*, 47*b*, 47*c*, 47*d*, 47*e* and 47*f*** respectively.

Air pressure is applied to the upper surface of the upper diaphragm 43 by means of an air inlet fitting 51 and, in the opposite condition of the valves 24 and 25, air pressure is supplied to the bottom side of the lower diaphragm member 44 through an air inlet fitting 52. The diaphragms are thus responsive to the sum of two air pressure signals.

Figure 2:
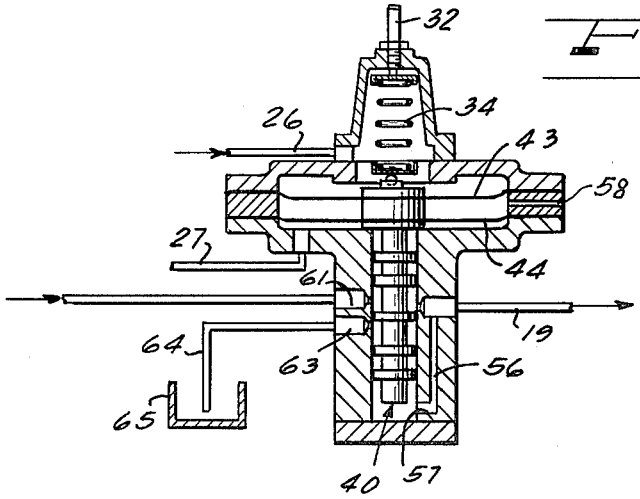
FIG. 2 is a view similar to FIG. 1, but illustrating the valve alone in a condition in which air pressure is being introduced against the upper of the two diaphragm assemblies.

The operation of the pressure modulating valve 21 can best be explained in conjunction with the somewhat simplified showings of FIGS. 1 and 2. In FIG. 1, valve 25 is shown delivering air from the air pressure source through a conduit 27 into the lower air inlet 52. This air pressure tends to lift the lower diaphragm 44 and the spool 40 in opposition to the spring bias provided by the spring 34 and the air pressure acting at the top of diaphragm 43. Consequently, hydraulic liquid will flow back into the valve 21 through an outlet fitting 55, into an internal feedback passage 56, through a port 57 and thence through the port **47*f* so that it acts against the bottom of the spool 40. The liquid pressure acts over the entire area of the spool 40, applying an upward force on the spool which also opposes the force of the spring 34. The difference between the spring force and the force acting on the lower diaphragm 44 is balanced by the upward force produced by the valve outlet liquid pressure. Consequently, piston 17 is able to rise in the cylinder 18 and the rider roll 14 is lowered against the periphery of the roll 13 being wound by winder drums 11 and 12**.

In the opposite condition, when the valve 24 applies high pressure air to the conduit 26, high pressure air enters through the fitting 51 and acts on the upper surface of the upper diaphragm 43 as shown in FIG. 2. Now, the spool 40 moves downward because of the combined action of the bias of the spring 34 and the air pressure acting against the upper diaphragm 43, and opposed by the air pressure acting upwardly on diaphragm 44. The spool 40 is moved in such a position that the control land 40*c* moves to a position in which oil under pressure introduced through an inlet fitting 61 flows through a port 47*b* in the sleeve and then between the lands 40*b* and 40*c*, through a port 47*c* and then through the outlet fitting 55. As the oil pressure builds up at the outlet fitting 55, the outlet pressure goes through the internal feedback provided by passages 56 and 57 to the bottom of the spool 40. The oil pressure acts over the entire area of the spool, applying an upward force on the spool which then opposes the spring bias provided by the spring 34. As the outlet oil pressure increases, the force on the bottom of the spool 40 increases until the two forces are equal and a substantial equilibrium is achieved. This balances the valve spool 40 at the pressure determined by the spring 34. Any further increase in outlet oil pressure causes the spool to shift upward causing the spool lands to close off communication between the inlet 61 and the outlet 55 for the oil and, instead, direct the excess oil to bleed off through a drain fitting 63 whereupon the oil passes through a conduit 64 into a drain 65. During the time oil is being supplied to the cylinder 18 from the outlet fitting 55, the piston 17 moves downward, thereby raising the rider roll 14 with respect to the paper roll 13.

In setting up the system, the valves 24 and 25 are open to the atmosphere, and the stud 32 is manually adjusted to place enough hydraulic pressure in the cylinders 18 to just counterbalance the rider roll 14.

To raise the rider roll 14, the valve 24 is operated to decrease the air pressure against diaphragm 43, thereby increasing the hydraulic pressure in the cylinders 18, lifting the rider roll 14. Conversely, when the valve 25 is operated to decrease the air pressure against diaphragm 44, the hydraulic pressure in the cylinders 18 decreases, lowering the rider roll 14. With the rider 14 lowered, the nip loading is increased by increasing the air pressure by means of valve 25. The operator thus increases the air pressure at the control station to increase rider roll pressure, and vice versa. The winding on the winding drums is begun with a heavier nip load and gradually this load is decreased as the roll of paper builds up on the winder drums.

From the foregoing, it will be seen that the system of the present invention provides an improved rider roll pressure adjustment with a single modulating control valve which is both a pressure reducing and a pressure relieving valve. The system of the present invention therefore simplifies the control of pneumatic and hydraulic pressures in a rider roll raising system without a sacrifice in efficiency.

It will be evident that various modifications can be made to the described embodiments without departing from the scope of the present invention.

I claim as my invention:

1. In a paper winder assembly including:

a pair of winder drums, for receiving a roll of paper being wound, a rider roll positioned to bear against said roll of paper with a variable pressure, and hydraulically actuated lifting means including a piston and cylinder associated with said rider roll to vary the pressure at which said rider roll bears against said roll of paper, said rider roll applying a maximum pressure to said roll of paper when said pressure in said cylinder is a minimum, the improvement which comprises:

a valve for controlling flow of hydraulic fluid to said lifting means having upper and lower flexible diaphragms therein in axially spaced relation, each of said diaphragms having a constant effective area, an actuator in said valve movable in response to movement of either of said diaphragms, means for selectively introducing pressurized air into said valve which acts on said effective areas to deflect one or the other of said diaphragms, inlet means for introducing pressurized liquid into said valve, outlet means for directing a flow of pressurized liquid from said valve into said cylinder in said hydraulically actuated lifting means, said actuator being disposed between said inlet and outlet means to control liquid flow therebetween, bias means producing a selected force normally urging said actuator to a position allowing liquid communication between said inlet and outlet means, means within said valve operable in response to movement of said actuator for diverting some of the flow through said outlet means and into pressure applying relation with said actuator, said actuator being movable into a position wherein the flow of pressurized liquid through said outlet means is terminated when the pressure applied by the diverted flow equals said selected force, whereby liquid flow through said valve increases as pressure acting on said upper diaphragm decreases to raise said rider roll, and liquid flow through said valve decreases as pressure acting on said lower diaphragm increases to lower said rider roll.

2. A paper winder assembly according to claim 1 which includes:

drain means in said valve for diverting excess liquid when flow of liquid into said outlet means is terminated.

* * * * *